United States Patent [19]

Causey et al.

[11] 4,331,452

[45] May 25, 1982

[54] APPARATUS FOR CRYSTAL SHAPING

[75] Inventors: Donald R. Causey; Owen Fredericks, both of Healdsburg, Calif.

[73] Assignee: Fairchild Camera and Instrument Corporation, Mountain View, Calif.

[21] Appl. No.: 175,174

[22] Filed: Aug. 4, 1980

[51] Int. Cl.[3] ..... B24B 7/22; B24B 5/04; B24B 1/00

[52] U.S. Cl. ..... 51/5 R; 51/56 R; 51/123 R; 51/283 R

[58] Field of Search ..... 51/5 R, 122, 123 R, 51/283 R; 250/272, 277, 320

[56] References Cited

U.S. PATENT DOCUMENTS

| | | | |
|---|---|---|---|
| 135,131 | 1/1873 | Kohler | 51/122 |
| 1,918,951 | 1/1931 | Anderson | 51/123 R |
| 2,425,750 | 8/1947 | McCarty | 51/283 |
| 2,556,167 | 6/1951 | Coleman | 125/35 |
| 2,947,214 | 8/1960 | Schwuttke et al. | 125/35 |
| 3,626,644 | 12/1971 | Cupler | 51/283 |

*Primary Examiner*—Stephen G. Kunin
*Assistant Examiner*—Robert A. Rose
*Attorney, Agent, or Firm*—Paul J. Winters; Theodore S. Park; Kevin McMahon

[57] ABSTRACT

In the present invention, a length of elongated single crystal ingot is mounted adjacent its ends and is ground while being rotated to provide a cylindrical shape. While still mounted, the crystal is rotated into a position to be x-rayed for the grinding of a flat thereon with the crystal in a non-rotated state.

1 Claim, 2 Drawing Figures

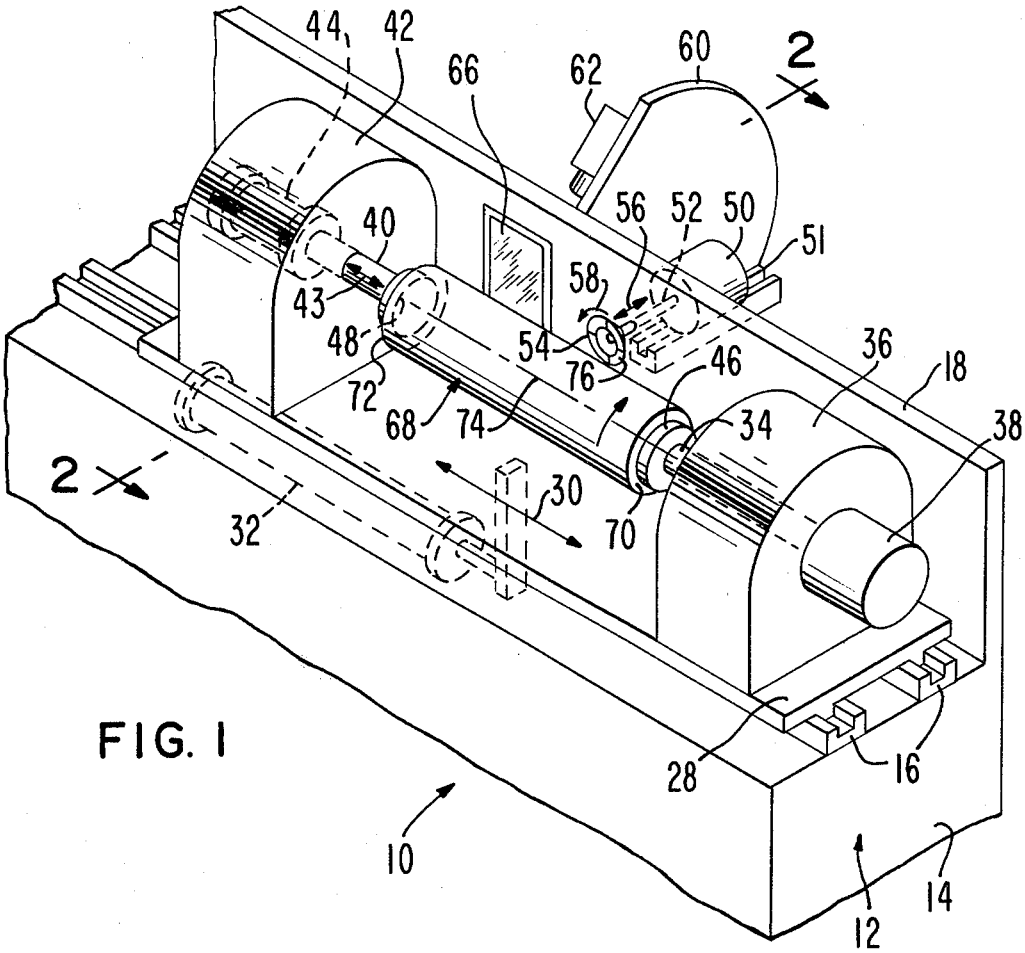
FIG. 1
FIG. 2
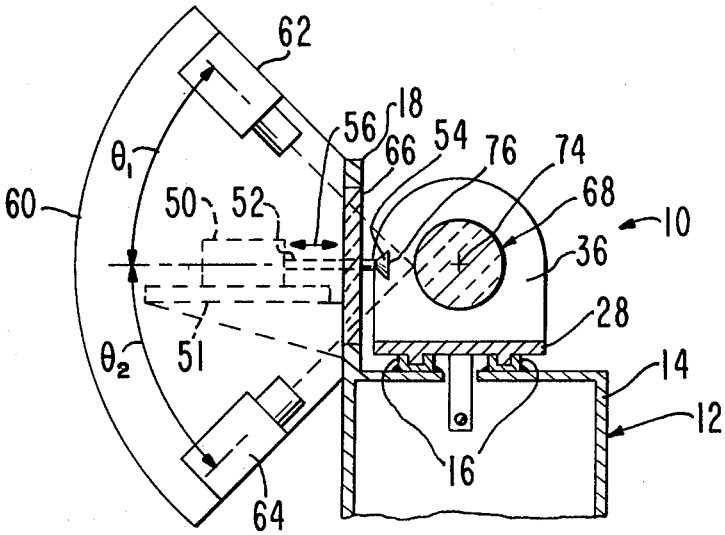

APPARATUS FOR CRYSTAL SHAPING

BACKGROUND OF THE INVENTION

This invention relates to crystal shaping, and more particularly, to method and apparatus for grinding a crystal.

In the processing of a single crystal, it is well known to bond mounting pads to the respective opposite ends of the crystal, and to mount the crystal for rotation about its longitudinal axis. As the crystal is so rotated, a grinding element is brought into contact with the surface of the crystal, and the grinding element is moved along the longitudinal axis of the crystal so that an overall cylindrical surface is achieved. Subsequently, the crystal is removed, and it is placed in an x-ray apparatus whereupon x-rays are beamed toward the crystal at a certain angle relative thereto, and a counter is positioned to receive the x-rays reflected from the crystal, also at a certain angle relative to the crystal. In a well-known manner, the crystal is rotated slowly about its longitudinal axis until the reflection of the x-rays as observed in the counter is at a maximum. Depending upon the angles chosen, the reticular plane of a certain crystal orientation may be chosen and marked. The crystal is then removed from the x-ray apparatus and mounted to another apparatus for the grinding of the flat thereon.

It will readily be seen that the above-described method involves a number of time-consuming steps. Also, it will readily be noted that the crystal, in itself an expensive and relatively delicate structure, is handled a large number of times, increasing the possibility that damage to and/or contamination thereof will occur.

SUMMARY OF THE INVENTION

It is accordingly an object of the present invention to overcome the above problems by providing a method and apparatus for shaping a crystal which reduces handling and time necessary for the shaping thereof.

Broadly stated, the invention comprises apparatus for shaping a crystal comprising a base, means mounted to the base for rotatably mounting a crystal, means for selectively grinding a flat along a selected portion of a non-rotating crystal.

Broadly stated, the invention also comprises a method of shaping a crystal comprising mounting the crystal, rotating the so-mounted crystal about an axis thereof, grinding the surface of the so-mounted crystal to a substantially cylindrical shape, x-raying the so-mounted crystal, and grinding a flat along the surface of the so-mounted crystal in a non-rotating state.

BRIEF DESCRIPTION OF THE DRAWINGS

These and other objects of the invention will become apparent from the following specification and drawings, in which:

FIG. 1 is a perspective view of the present apparatus; and

FIG. 2 is a view taken along the line 2—2 of FIG. 1.

DESCRIPTION OF THE PREFERRED EMBODIMENTS

Shown in FIG. 1 is the overall apparatus 10 which is the subject of the present invention. As shown therein, the apparatus 10 includes a base 12 having a bottom portion 14, tracks 16 mounted to the top portion 14, and a back plate 18. Movably mounted on the tracks 16 is a table 28. The table 28 is movable back and forth as shown at 30 by means of an extendable and retractable cylinder 32.

A rotatable shaft 34 is mounted in a casing 36 in turn mounted to the table 28, and may be selectively rotated by means of an electric motor 38. A similar rotatable shaft 40 is mounted in a casing 42 and in turn is mounted to the table 28, the shaft 40 actually being a rod portion of an extendable and retractable (43) hydraulic cylinder 44. Pads 46, 48 are secured to the respective inwardly extending ends of the shafts 34, 40.

An electric motor 50 is rotatably mounted to a track 51 in turn secured to the back plate 18, the electric motor 50 selectively driving a rotatable shaft 52 which extends through the back plate 18 and which has a circular grinding wheel 54 fixed thereto. The grinding wheel may thus be moved along the line shown at 56, and rotated as shown at 58.

As best shown in FIG. 2, the back plate 18 has mounted to the rear thereof a support plate 60 (making up part of the base 12) in turn having mounted thereto an x-ray source 62 and a counter 64. The back plate 18 defines a window 66 the utility of which will be described further on.

In the use of the apparatus 10, a length of elongated single crystal ingot 68 is positioned as shown in FIG. 1, i.e., actually being mounted at its ends by initial positioning of the end 70 against the pad 46, and bringing the pad 48 into contact with the opposite end 72 by extension of the cylinder 44. The crystal 68 is rotated about its longitudinal axis 74 by means of the electric motor 38, and the electric motor 50 is brought toward the crystal 68 with the shaft 52 being rotated, until the surface 76 of the grinding wheel 54 is in engagement with the surface of the crystal 68. As the surface of the crystal 68 is ground by the grinding wheel 54, the cylinder 32 is actuated to move the crystal 68 along its longitudinal axis 74 so that the so-mounted crystal 68 is ground to a substantially cylindrical shape.

Subsequent to such grinding operation, it is to be understood that a flat is to be ground along the crystal 68 parallel to the longitudinal axis 74 of the crystal 68 by means of the very same rotary grinding wheel 54. Toward this end, and in order to find the exact plane along which the flat should be ground, rotation of the crystal 68 as described above is stopped. In well known fashion, the angles 0 and 20 (in reference to the counter) have been chosen in accordance with well-known procedure, depending on the plane along which the flat is to be cut. It will be understood that with those angles set, depending on the chosen plane, the x-ray apparatus is actuated, and the crystal 68 is rotated until reflection of the x-ray beam is at a maximum, determining that the crystal 68 is in proper position to that in turn the rotating grinding wheel 54 may be brought into position against the crystal 68. The crystal 68 is then moved (in a non-rotating state) along its longitudinal axis 74 by means of actuation of the cylinder 32, so that a flat is grounded along the entire length of the crystal 68.

It will be seen that the window 66 is appropriately placed so that the x-ray beam passes therethrough on its way to the crystal 68 and subsequent to reflection thereof by the crystal 68 on its way to the counter 64. The back plate 18, including such window 66, provides for proper protection of the x-ray apparatus, meanwhile allowing proper operation thereof.

It will therefore be seen that the grinding of a crystal into a cylindrical shape, and the subsequent provision of a properly oriented flat therealong, are provided in a highly convenient and efficient manner. The crystal need not be handled a number of times as in the prior art system, and the overall operation as described can be undertaken in a very short time.

I claim:

1. A unitary apparatus for shaping a crystal ingot into a crystal blank at a single station, the resulting crystal blank having a cylindrical surface with a flat thereon wherein the flat is oriented with respect to a crystal plane selected by observing reflected x-rays and wherein the flat extends along the length of the crystal parallel to the axis of the cylindrical surface, the apparatus comprising:

a base;

means mounted on the base for mounting the crystal, said mounting means including therewith means for rotating the crystal continuously about the axis thereof and means for translating the crystal back and forth in the direction that the axis extends while continuously rotating the crystal ingot;

a grinding wheel having a flat grinding surface extending perpendicular to the axis of rotation of the grinding wheel to provide a radial grinding face, the grinding wheel having a diameter less than that of the crystal ingot;

means for mounting the grinding wheel on the base with the axis of rotation thereof extending perpendicular to the axis of the mounted crystal ingot, said grinding wheel mounting means including means for rotating the grinding wheel and means for moving the grinding wheel in the direction of its axis of rotation to move the radial grinding face into engagement with the crystal ingot, wherein as the crystal ingot is rotated and translated the grinding wheel abrades the surface of the ingot to generate a cylindrical outer surface thereon;

an x-ray source and receptor mounted on the base and aligned with the surface of the crystal wherein as the crystal is slowly rotated an area for generating a flat thereon is selected when the intensity of reflected x-rays is at a maximum, and means for translating the crystal in the direction of its axis without rotating the crystal and while rotating the grinding wheel with the radial grinding face of the grinding wheel in engagement with the crystal to generate the flat, whereby a crystal ingot is shaped into a cylindrical crystal blank with a flat thereon by use of a single apparatus at a single station without having to manually handle the crystal between the cylindrical shaping, x-ray measuring and flat generating operations.

* * * * *